US009456705B2

(12) United States Patent
Zangari et al.

(10) Patent No.: US 9,456,705 B2
(45) Date of Patent: Oct. 4, 2016

(54) DUAL TEMPERATURE REFRIGERATED MERCHANDISER

(71) Applicant: Hussmann Corporation, St. Louis, MO (US)

(72) Inventors: Jony M. Zangari, Hoschton, GA (US); Oswaldo Carrillo, Bridgeton, MO (US)

(73) Assignee: Hussmann Corporation, Bridgeton, MO (US)

( * ) Notice: Subject to any disclaimer, the term of this patent is extended or adjusted under 35 U.S.C. 154(b) by 670 days.

(21) Appl. No.: 13/797,515

(22) Filed: Mar. 12, 2013

(65) Prior Publication Data

US 2014/0096545 A1 Apr. 10, 2014

Related U.S. Application Data

(60) Provisional application No. 61/711,188, filed on Oct. 8, 2012.

(51) Int. Cl.

| | |
|---|---|
| ***A47F 3/04*** | (2006.01) |
| ***F25D 21/04*** | (2006.01) |
| ***F25D 19/02*** | (2006.01) |
| *F25D 21/08* | (2006.01) |
| *F25D 23/02* | (2006.01) |

(52) U.S. Cl.

CPC ..... *A47F 3/0426* (2013.01); *A47F 3/0478* (2013.01); *F25D 19/02* (2013.01); *F25D 21/04* (2013.01); *F25D 21/08* (2013.01); *F25D 23/02* (2013.01); *F25D 2400/16* (2013.01)

(58) Field of Classification Search

CPC .. A47F 3/0413; A47F 3/0452; A47F 3/0491; A47F 3/042; A47F 3/0478; F25D 11/02; F25D 11/022; F25D 13/02; F25D 13/04; F25D 21/08; F25D 21/04; F25D 19/02; F25D 23/02; F25D 2400/16

USPC ..... 62/249, 252, 255, 256, 441, 448

See application file for complete search history.

(56) References Cited

U.S. PATENT DOCUMENTS

| | | | | |
|---|---|---|---|---|
| 1,979,625 | A * | 11/1934 | Knapp | 62/250 |
| 3,186,185 | A * | 6/1965 | Bently et al. | 62/255 |
| 3,712,078 | A * | 1/1973 | Maynard et al. | 62/448 |
| 4,135,369 | A * | 1/1979 | Allgeyer et al. | 62/251 |
| 4,369,632 | A * | 1/1983 | Abraham | 62/82 |
| 4,462,460 | A * | 7/1984 | Braver | 165/207 |
| 4,899,554 | A * | 2/1990 | Kato et al. | 62/442 |

(Continued)

*Primary Examiner* — Tho V Duong
*Assistant Examiner* — Raheena Rehman
(74) *Attorney, Agent, or Firm* — Michael Best & Friedrich LLP

(57) ABSTRACT

A merchandiser system includes a case that has a door and a door heater. The system includes a low temperature refrigeration unit sized to fit within a case compartment and to operably couple to the case to maintain food product within a low temperature range. The system also includes a medium temperature refrigeration unit sized to fit within the compartment and operably couple to the case to maintain food product within a medium temperature range. The system includes a controller in communication with the door heater and is programmed to activate the door heater only in response to the low temperature modular refrigeration unit positioned within the compartment. One of the low temperature refrigeration unit and the medium temperature refrigeration unit is removably coupled to the case within the compartment, and is replaceable by the other refrigeration unit to change the temperature range of the product display area.

20 Claims, 5 Drawing Sheets

(56) References Cited

U.S. PATENT DOCUMENTS 5,199,273 A * 4/1993 Silva ..... F25D 19/02 49/478.1
5,347,827 A * 9/1994 Rudick et al. ..... 62/440
5,709,096 A * 1/1998 Tamai et al. ..... 62/155
7,703,295 B2 * 4/2010 Zangari et al. ..... 62/298
7,730,732 B2 * 6/2010 Kaga ..... F25D 19/02 236/1 C
7,775,058 B2 * 8/2010 Kaga ..... F25D 21/04 62/157
7,908,039 B2 * 3/2011 Kaga ..... F25B 49/025 236/44 B
7,997,094 B2 * 8/2011 Zangari et al. ..... 62/129
2005/0126196 A1 * 6/2005 Grassmuck ..... A47F 3/0482 62/251
2008/0141689 A1 * 6/2008 Sunderland et al. ..... 62/151
2009/0090114 A1 * 4/2009 Choo ..... 62/80

* cited by examiner

DUAL TEMPERATURE REFRIGERATED MERCHANDISER

This application claims priority to U.S. Provisional Application No. 61/711,188, filed Oct. 8, 2012, the entire contents of which are incorporated herein by reference.

BACKGROUND

The present invention relates to refrigerated merchandisers, and specifically to dual temperature refrigerated merchandisers that condition low and medium temperature product display areas.

Existing refrigerated merchandisers typically include a case that defines one or more display areas accessible by consumers from the front of the case. Some merchandisers include doors that enclose the product display area. The display area is cooled by a refrigeration system that includes an evaporator assembly and a condenser assembly arranged in a circuit, and a fan distributes cooled air toward the product display area. In some merchandisers, the condenser and evaporator assemblies are positioned separate and remote from each other within the refrigerated merchandiser. In some cases, the refrigeration system is modular and can be removed from the merchandiser as a unit. For example, U.S. Pat. No. 7,703,295, assigned to Hussmann Corporation, describes and illustrates a merchandising display cooler that includes an accessible compartment for receiving a removable refrigeration unit, the refrigeration unit including both an evaporator assembly and a condenser assembly.

Typically, the product display area of existing merchandisers is maintained within a predetermined temperature range that depends on the type of product to be cooled. For example, a low temperature merchandiser typically maintains the product display area at temperatures less than 32 degrees Fahrenheit, whereas a medium temperature merchandiser typically maintains the product display area at temperatures between 33-41 degrees Fahrenheit. Often, existing merchandisers include either a low temperature refrigeration system or a medium temperature refrigeration system.

In some existing low temperature merchandisers, the product display temperature provided by the low temperature refrigeration system is adjusted via electronic control to a temperature that is warmer than the low temperature range for which the refrigeration system is designed. However, product in the product display areas of these merchandisers frequently freezes due to very cold discharge air upon startup of the low temperature refrigeration system. That is, because these low temperature refrigeration systems frequently use a large compressor, which is designed to lower the suction temperature to accommodate the low temperature range, air discharged into the product display area is much colder than desired when trying to use the low temperature system in this manner.

While some of these systems incorporate a suction pressure regulating valve in addition to a solenoid valve to avoid frozen product, these systems are typically manually actuated. Also, regardless of how existing systems try to avoid frozen product, use of low temperature refrigeration systems to accommodate a product display temperature associated with a medium temperature merchandiser significantly lowers the efficiency of the merchandiser and necessitates additional components and complex controls.

SUMMARY

In one construction, the invention provides a refrigerated merchandiser system including a case defining a product display area to support food product. The case has a door adjacent a front of the case and a door heater that is coupled to the door, and the case defines a compartment. The system includes a low temperature modular refrigeration unit sized to fit within the compartment and operably couple to the case to maintain food product within a low temperature range, and a medium temperature modular refrigeration unit sized to fit within the compartment and operably couple to the case to maintain food product within a medium temperature range. The system includes a controller in communication with the door heater, and the controller is programmed to activate the door heater only in response to the low temperature modular refrigeration unit positioned within the compartment. One of the low temperature modular refrigeration unit and the medium temperature modular refrigeration unit is removably coupled to the case within the compartment. The modular refrigeration unit removably coupled to the case is replaceable by the other modular refrigeration unit to change the temperature range of the product display area.

In another construction, the invention provides a refrigerated merchandiser system including a case defining a product display area to support food product. The case has a door adjacent a front of the case and a door heater that is coupled to the door, and the case defines a compartment. The system includes a low temperature modular refrigeration unit sized to fit within the compartment and operably couple to the case to maintain food product within a low temperature range, the low temperature modular refrigeration unit including an electronic control. The system includes a medium temperature modular refrigeration unit sized to fit within the compartment and operably couple to the case to maintain food product within a medium temperature range, the medium temperature modular refrigeration unit including an electronic control. The system includes a controller in electrical communication with the electronic control on one of the low temperature modular refrigeration unit and the medium temperature refrigeration unit, and in electrical communication with the door heater. The controller is programmed to activate the door heater only in response to the low temperature modular refrigeration unit positioned.

In another construction, the invention provides a method of controlling condensation in a merchandiser having a case defining a product display area includes determining whether the merchandiser is using a low temperature modular refrigeration unit disposed in the merchandiser, and determining whether the merchandiser is using a medium temperature modular refrigeration unit disposed in the merchandiser. The method includes determining whether a product display temperature is above a predetermined threshold in response to determining that the merchandiser is using a low temperature modular refrigeration unit, and activating a door heater to remove condensation from a door on the merchandiser in response to determining that the product display temperature is above the predetermined threshold. The method includes turning off the door heater in response to determining that the product display temperature is below the predetermined threshold.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
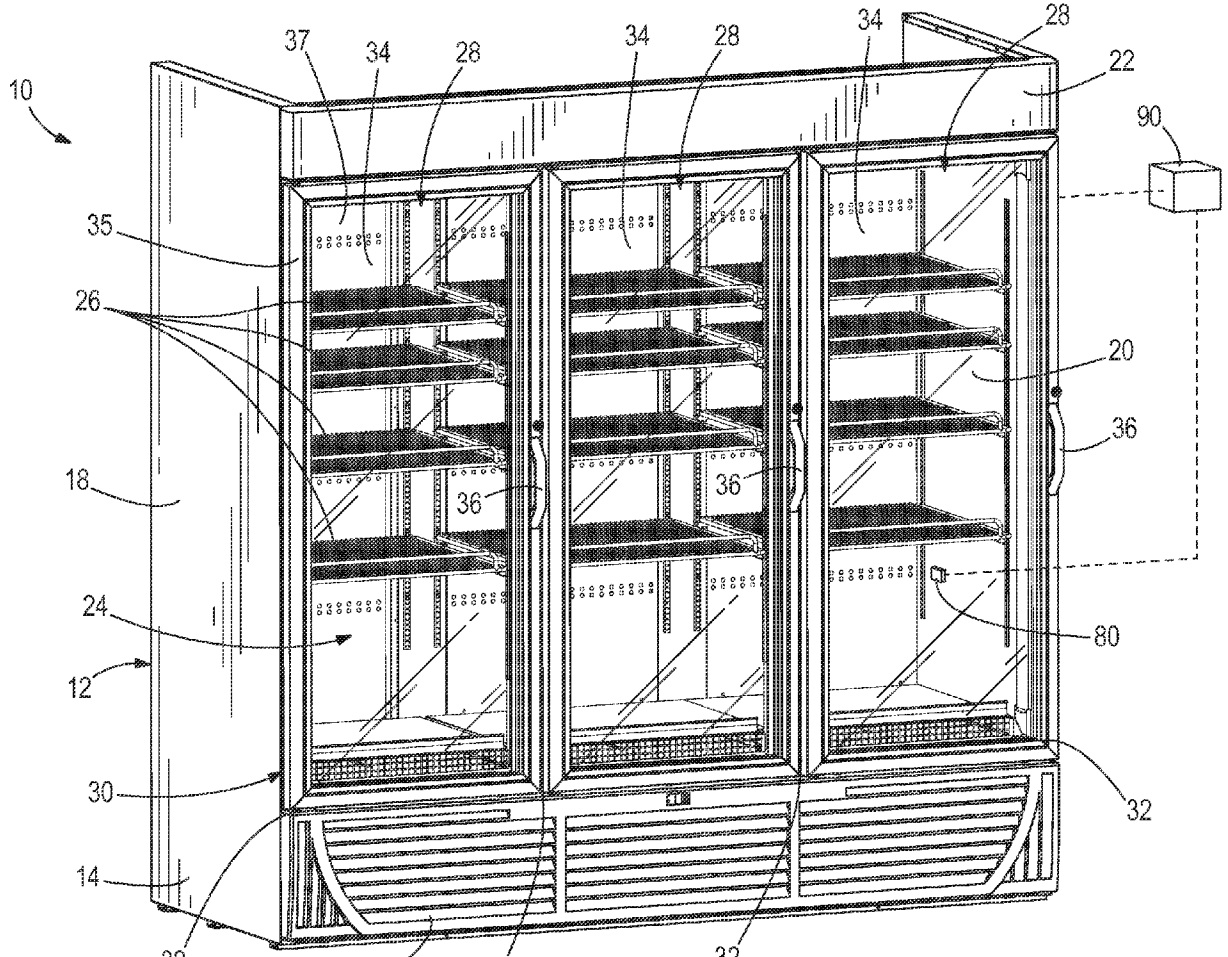
FIG. 1 is a front perspective view of a refrigerated merchandiser embodying the present invention.
Figure 2:
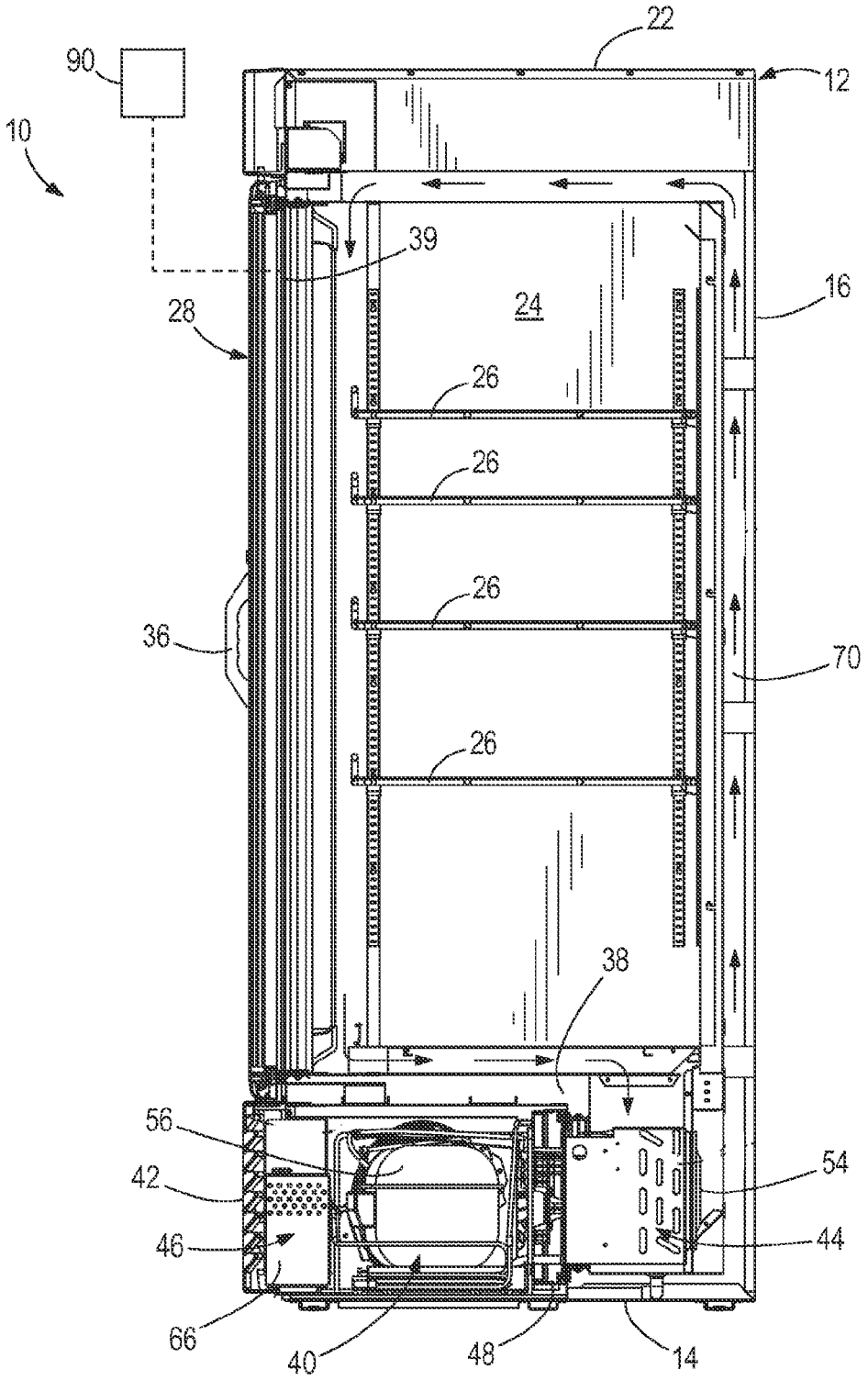
FIG. 2 is a cross-section of the refrigerated merchandiser of FIG. 1, illustrating a removable modular refrigeration unit disposed in the merchandiser.

FIGS. 1 and 2 show a refrigerated merchandiser 10 that may be located in a supermarket or a convenience store (not shown) for presenting fresh food, beverages, and other food product to consumers. The refrigerated merchandiser 10 includes a case 12 that has a base 14, a rear wall 16, side walls 18, 20, and a canopy 22. The area partially enclosed by the base 14, the rear wall 16, and the canopy 22 defines a product display area 24 for supporting the food product in the case 12. For example, the food product can be displayed on racks or shelves 26 extending forwardly from the rear wall 16, and is accessible by consumers through doors 28 adjacent the front of the case 12.

The case 12 can include a frame 30 adjacent a front of the merchandiser 10. FIG. 1 shows that the frame 30 includes vertical mullions 32 that define openings 34, with the doors 28 positioned over the openings 34. The openings 34 and the doors 28 allow access to food product stored in the product display area 24. The mullions 32 are spaced horizontally along the case 12 to provide structural support for the case 112. Each mullion 32 is defined by a structural member that can be formed from a nonmetallic or metallic material. A handle 36 is positioned along an edge of each door 28 to move the door 28 between an open position and a closed position. In the illustrated construction, the refrigerated merchandiser 10 includes three doors 28. In other constructions, the refrigerated merchandiser 10 may include fewer or more than three doors 28 depending on the size of the case 12

Each door includes a door frame 35 and a glass member 37 that is secured to each door 28 by the respective door frame 35 to allow viewing of the food product from outside the case 12. The glass member 37 can include one or more glass panes that have a low-emissivity coating. Condensation generally forms on a surface of the glass member when the temperature of the surface is lower than a dew point of air that is in contact with the surface. Condensation is a result of a combination of surface temperature and moisture in the surrounding air. Thus, condensation can form on an interior surface of the glass member after the door has been opened due to exposure of the generally cold interior surface to generally warm ambient conditions. Similarly, condensation can form on an exterior surface of the glass member when the temperature of the exterior surface is below the dew point of the ambient air.

In the illustrated construction, a door heater 39 in the form of an electrically conductive film or resistive coating is adhered to the interior surface of each glass member 37. The conductive film is generally transparent to minimize interference with viewing the food product stored in the product display area 24. In some constructions, the conductive film may be adhered to the exterior surface of the glass member 37, or alternatively, to the interior surface and the exterior surface.

Figure 3:
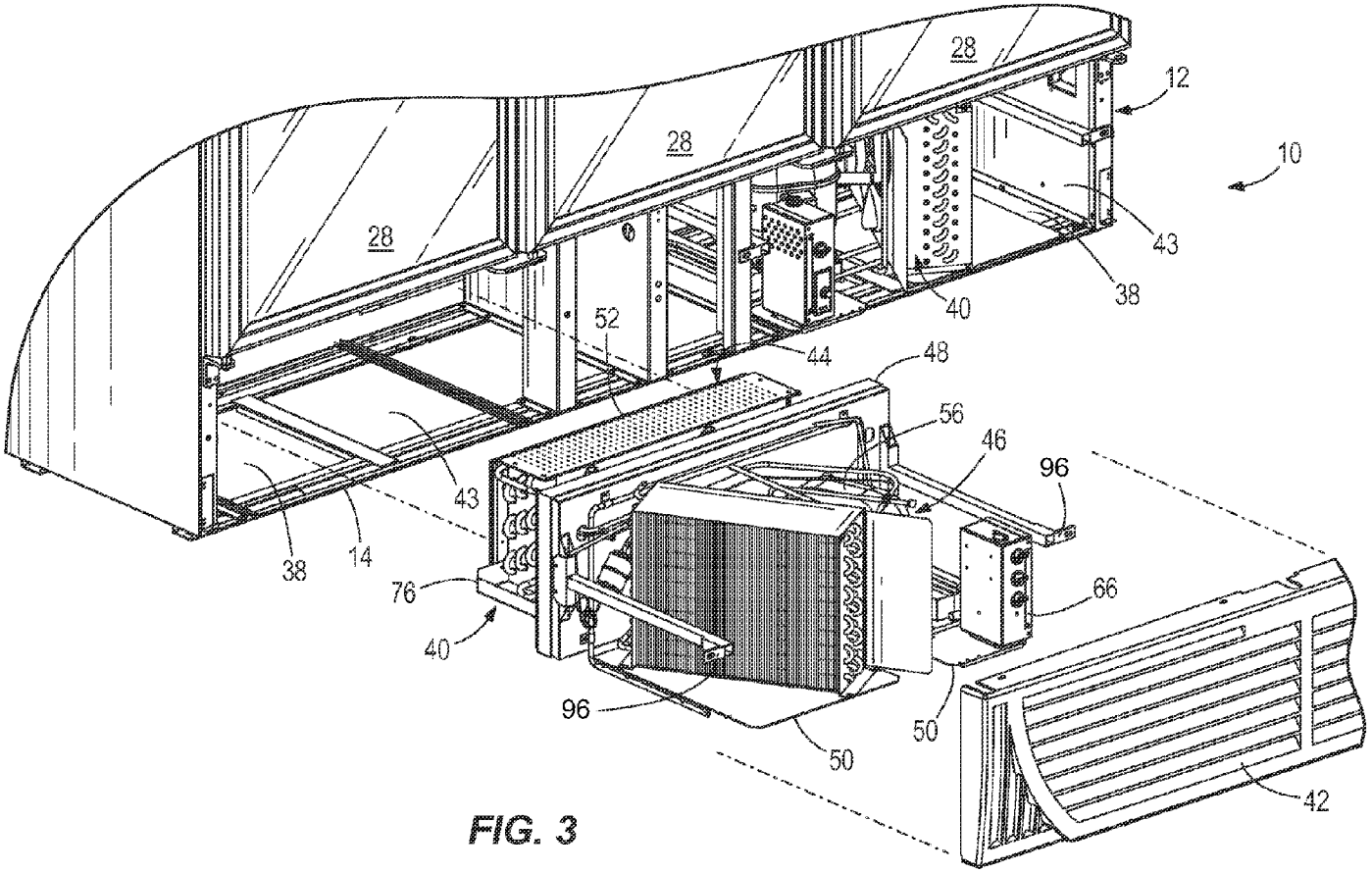
FIG. 3 is an exploded perspective view of a portion of the refrigerated merchandiser and the modular refrigeration unit of FIG. 2.

Referring to FIGS. 1-3, the base 14 defines refrigeration unit compartments 38 that support refrigeration units 40. As shown in FIGS. 1-3, the compartments 38 are covered by a removable grill 42, and include front side openings 43 for inserting and removing the refrigeration units 40 relative to the case 12. The refrigerated merchandiser 10 is equipped with a harness and quick connect features for quickly coupling the refrigeration units 40 electrically to the case 12. Although two compartments 38 are illustrated, fewer or more than two compartments 38 (and refrigeration units 40) can be provided in the merchandiser 10 depending in part on the length of the merchandiser 10 and the amount of cooling needed to condition the product display area 24.

Figure 4:
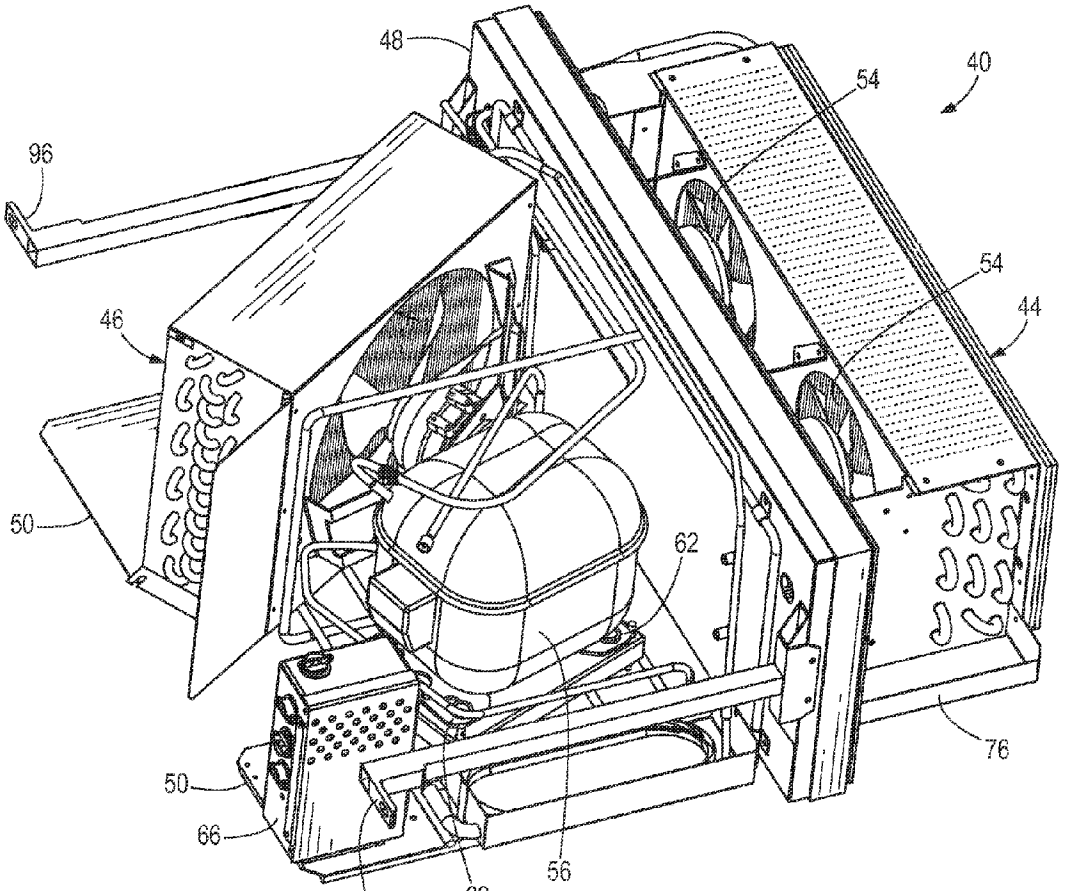
FIG. 4 is a perspective view of the modular refrigeration unit.

With reference to FIGS. 3 and 4, each refrigeration unit 40 defines a modular unit that can be inserted into and removed from one compartment 38. As illustrated in FIGS. 2-4, the refrigeration unit 40 defines a closed refrigerant circuit and includes an evaporator 44, a compressor 56 (e.g., one compressor or several compressors in an assembly), and a condenser 46. The refrigeration unit 40 can also include other components.

The evaporator 44 (e.g., microchannel or round tube plate-fin) is fluidly coupled with the compressor to deliver evaporated refrigerant from the evaporator to the compressor, and is fluidly coupled with the condenser to receive cooled, condensed refrigerant from the condenser 95. An expansion valve (not shown) is disposed between the evaporator 44 and the condenser to create a pressure differential and to control the pressure of the refrigerant fluid delivered to the evaporator 44. As illustrated, the refrigeration unit 40 is positioned in the compartment 38 so that the evaporator 44 is disposed adjacent the rear wall 16. The evaporator 44 is in communication with an air passageway 70 disposed within the case 12 and in communication with the product display area 24. As illustrated, fans 54 are coupled to the evaporator to direct an airflow through the evaporator 44 and the air passageway to the product display area 24. With reference to FIG. 4, an evaporator pan 76 is positioned under the evaporator 44 to collect any condensed moisture dripping from the evaporator 44.

The evaporator 44 is mounted to a dividing wall 48, and the compressor and the condenser 46 are separated from the evaporator 44 by the dividing wall 48. As illustrated, the compressor 56 and the condenser 46 are mounted on supports 50 that are coupled to the dividing wall 48 and are disposed adjacent and accessible from a front of the case 12 when the refrigeration unit 40 is installed in the merchandiser 10. Referring to FIGS. 3 and 4, support 50 includes forward gripping portions 96 that provide an operator with a convenient gripping surface for moving a refrigerator system 40 into or out of the accessible compartment 38.

As is known in the art, the evaporator 44 receives a saturated refrigerant that has passed through an expansion valve (not shown). The saturated refrigerant is evaporated as it passes through the evaporator 44 as a result of absorbing heat from the airflow passing over the evaporator assembly 44. The absorption of heat by the refrigerant allows the temperature of the airflow to decrease as it passes over the evaporator assembly 44. The heated or gaseous refrigerant then exits the evaporator 44 and is pumped back to the compressor 56 for re-processing into the refrigeration unit 40. The cooled airflow exiting the evaporator assembly 44 via heat exchange with the liquid refrigerant is directed through the remainder of the air passageway and is introduced into the product display area 24 where the airflow will remove heat from and maintain the food product at desired conditions.

The refrigerated airflow provided by the evaporator 44 conditions the product display area 24 within a predetermined temperature range based on the type of product supported in the product display area 24. When the merchandiser 10 is a low temperature merchandiser, a low temperature refrigeration unit 40 is positioned in the compartment 38 to condition the airflow so that the product display area 24 is maintained, for example, at or below 32 degrees Fahrenheit. When the merchandiser 10 is a medium temperature merchandiser, a medium temperature refrigeration unit 40 is positioned in the compartment 38 to condition the airflow so that the product display area 24 is maintained within a temperature range of for example, 33-41 degrees Fahrenheit.

The refrigeration units 40 can be either low temperature refrigeration units or medium temperature refrigeration units. Both low and medium temperature refrigeration units include an electronic control 66 (e.g., for controlling the components of the systems 40 based on the desired product display temperature and other factors). The illustrated electronic controls 66 are mounted to the supports 50, and the electronic controls 66 can be factory preset or adjusted prior to or during installation of the refrigeration unit 40.

The refrigeration units 40 are exchangeable. Thus, a low temperature refrigeration unit 40 is replaceable with a medium temperature refrigeration unit 40, and vice versa, to selectively alter the temperature range of the product display area 24. Alternatively, a damaged or older refrigeration unit 40 is replaceable by a new refrigeration unit 40.

In some constructions, the merchandiser 10 can include a partition (not shown) that divides the product display area 24 into a low temperature and medium temperature product display areas 24*a*, 24*b*. The partition can be permanent or removable, and defines a vertical wall that extends from the canopy to the base. The partition can be coupled to the case 12 via a quick lock system or another quick attach and release system. Depending on how the partition is installed in the case 12, one or more of the shelves 26 may be removed prior to insertion of the partition. Depending on the length of the merchandiser 10, one or more partitions can be provided to define a plurality of product display areas 24.

When a partition is provided in the merchandiser 10, a low temperature refrigeration unit 40 can be installed into one compartment 38 so that the corresponding product display area 24*a* conditions product within the low temperature range, and so that at least one of the doors 28 corresponds with the low temperature product display area 24*a* and low temperature refrigeration unit 40. A medium temperature refrigeration unit 40 can be installed into another compartment 38 so that the corresponding product display area 24*b* conditions product within the medium temperature range, and so that at least another of the doors 28 corresponds with the medium temperature product display area 24*b* and medium temperature refrigeration unit 40. In these constructions, each section of the merchandiser 10 can include at least one independently operable sensor 80 to control the door heaters 39, as described in detail below, based on the product display temperature (or other factors) and whether the refrigeration unit 40 for that section is a low temperature refrigeration unit 40.

FIG. 1 shows that the merchandiser 10 further includes a control system that has one or more sensors disposed inside the case 12, and a controller 90 in electrical communication with the merchandiser 10, the sensors, and the door heaters 39. As illustrated, the sensors are located adjacent the doors and are in communication with the product display area 24 to detect the product display temperature. In other constructions, the sensors can be located elsewhere in the merchandiser 10 (e.g., located along an interior portion of side walls 18, 20, behind the mullions 32, etc.), and can sense other characteristics of the case 12 that relate to fogging and condensation of the doors. The sensors are also in electrical communication with the controller 90 to deliver signals indicative of the product display temperature. The illustrated sensors are defined by bi-metal switches wired in series with the door heaters 39 to control the door heaters 39 based on the sensed temperature. The sensors can take any suitable form for detecting the temperature of the product display area 24 or other characteristics of the case 12, and for controlling the door heaters 39.

The controller 90 is in remote electrical communication with the door heaters to regulate current through the conductive film based on the signals received from the sensors. The current is passed through the conductive film, which heats the glass member to remove condensation. Alternatively the controller 90 can be attached to the merchandiser 10 in any suitable location (e.g., the base 14, on the case canopy 22, etc.).

Figure 5:
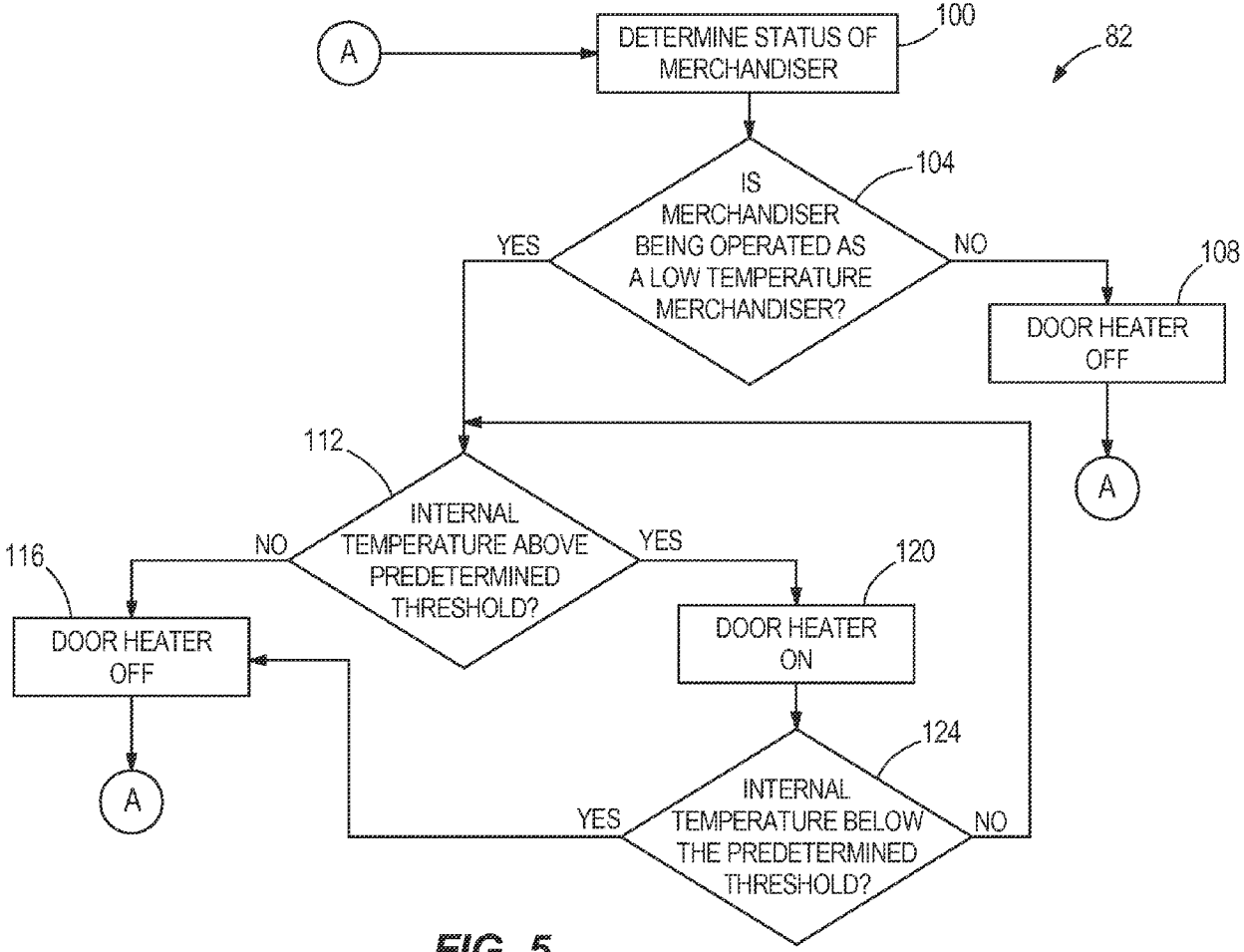
FIG. 5 is a flow chart of a control process for the refrigerated merchandiser of FIG. 1.

Generally, condensation only forms on the doors 28 when the merchandiser 10 is a low temperature merchandiser. FIG. 5 illustrates an exemplary control process for the merchandiser 10 to determine, among other things, when to apply heat to the doors 28. At step 100, the controller determines the status of the merchandiser 10 (e.g., whether the merchandiser 10 is operational, the conditions of the components supported by the merchandiser 10, etc.). At step 104, the controller determines whether the merchandiser 10 is being operated as a low temperature merchandiser 10 (i.e. has a low temperature modular refrigeration unit 40 disposed in a compartment 38), or a medium temperature merchandiser 10 (i.e. has a medium temperature modular refrigeration unit 40 disposed in a compartment 38). For example, the controller 90 can make this determination based on the product display temperature detected by the sensors, based on manual input from an operator, based on communication with the electronic controls 66, or based on other information indicative of the type of refrigeration unit 40 being used. If the merchandiser 10 has a medium temperature refrigeration unit 40 (i.e., the answer at step 104 is "No"), the door heaters 39 are turned off at step 108. The process then returns to step 100 and repeats. In some constructions, the control process can include a time delay after step 108 so that the determination at step 104 repeats at predetermined time intervals. In other constructions, the control process only makes the determination at step 104 once each time the merchandiser is varied from an "off" state to an "on" state.

If the merchandiser 10 has a low temperature refrigeration unit 40 (i.e., the answer at step 104 is "Yes"), the control process determines whether the product display temperature is above the predetermined temperature threshold at step 112. If the product display temperature is below this threshold (i.e., the answer at step 104 is "No"), the controller 90 keeps the door heaters 39 in an "off" state (i.e., no current is passed through the conductive film) at step 116. The control process then returns to step 100 and repeats.

If the product display temperature is above the predetermined temperature threshold (i.e., the answer at step 112 is "Yes"), the door heaters 39 are turned on at step 120 to inhibit or remove condensation from the doors 28. The control process then proceeds to step 124 to determine, at a later time, whether the product display area temperature is at or below the predetermined temperature threshold. If the product display temperature remains above the predetermined temperature threshold (i.e., the answer at step 124 is "No"), the door heaters 39 remain on and the control process returns to step 112. If the product display temperature is at or below the predetermined temperature threshold (i.e., the answer at step 112 is "Yes"), the door heaters 39 are turned off at step 116. The control process then returns to step 100 and repeats.

The control system regulates the merchandiser 10 so that when the merchandiser 10 is a low temperature merchandiser and the product display temperature rises above a predetermined temperature threshold, the controller 90 activates one or more of the door heaters 39 to warm the corresponding doors 28 to minimize or remove condensation on the doors 28. The control system also regulates the merchandiser 10 so that when the merchandiser 10 is a medium temperature merchandiser, the door heaters 39 are kept off regardless of the temperature in the product display area 24.

The modular refrigeration units 40 can be removed and installed relative to the case 12 so that the merchandiser 10 can operate as a low temperature merchandiser or a medium temperature merchandiser, or both. As illustrated, the controller 90 controls the door heaters 39 so that the doors 28 are only heated when the refrigeration unit 40 is a low temperature system and the product display area temperature is above the threshold. The sensors 80 keep the door heaters 39 off when the merchandiser 10 is a medium temperature merchandiser to limit the amount of power needed by the merchandiser 10 to operate. In constructions of the merchandiser 10 including a partition installed in the product display area 24, the sensors 80 can regulate each product display section so that the door heaters 39 are activated only when the section is a low temperature section and the corresponding product display temperature is above the predetermined threshold.

A single merchandiser 10 can be modified so that the merchandiser 10 encompasses a low temperature merchandiser, a medium temperature merchandiser, or a low and medium temperature merchandiser depending on desired characteristics for the merchandiser 10. The product display area or areas within the merchandiser 10 can be can be controlled and adjusted as desired by removing and replacing the low or medium temperature refrigeration units 40 with other low or medium temperature refrigeration units, and by removing or adding partitions within the merchandiser 10. For example, a low temperature refrigeration unit 40 in the merchandiser 10 can be replaced by removing the grill and the low temperature refrigeration unit 40, and installing another low temperature refrigeration unit 40 or a medium temperature refrigeration unit 40 in the compartment 38. Likewise, a medium temperature refrigeration unit 40 can be replaced by a low temperature refrigeration unit 40 or another medium temperature refrigeration unit 40.

Various features and advantages of the invention are set forth in the following claims.

The invention claimed is:

1. A refrigerated merchandiser system comprising:

a case defining a product display area to support product, the case having a door adjacent a front of the case and a door heater coupled to the door, and the case defining a compartment;

a low temperature modular refrigeration unit sized to fit within the compartment and operably couple to the case to maintain food product within a low temperature range;

a medium temperature modular refrigeration unit sized to fit within the compartment and operably couple to the case to maintain product within a medium temperature range; and a controller in communication with the door heater and programmed to activate the door heater only in response to the low temperature modular refrigeration unit positioned within the compartment, wherein one of the low temperature modular refrigeration unit and the medium temperature modular refrigeration unit is removably coupled to the case within the compartment, and wherein the modular refrigeration unit removably coupled to the case is replaceable by the other modular refrigeration unit to change the temperature range of the product display area.

2. The refrigerated merchandiser system of claim 1, wherein each of the low temperature modular refrigeration unit and medium temperature modular refrigeration unit defines a closed refrigerant circuit and includes an evaporator, a compressor, and a condenser.

3. The refrigerated merchandiser system of claim 1, wherein the low temperature range is at or below 32 degrees Fahrenheit.

4. The refrigerated merchandiser system of claim 1, wherein the medium temperature range is between 33-41 degrees Fahrenheit.

5. The refrigerated merchandiser system of claim 1, wherein the case includes two compartments and a partition positioned between the compartments, and wherein the each compartment accommodates one modular refrigeration unit.

6. The refrigerated merchandiser system of claim 5, wherein the product display area is defined by a low temperature product display area and a medium temperature product display area, and wherein the low temperature modular refrigeration unit is disposed in one of the two compartments to condition the low temperature product display area, and the medium temperature modular refrigeration unit is disposed in the other of the two compartments to condition medium temperature product display area.

7. The refrigerated merchandiser system of claim 1, further comprising a removable grill positioned adjacent the front of the case to partially enclose the compartment.

8. The refrigerated merchandiser system of claim 1, wherein each of the low temperature modular refrigeration unit and the medium temperature modular refrigeration unit includes a support and an electronic control mounted to the support.

9. The refrigerated merchandiser system of claim 1, wherein the case includes a base disposed below the product display area, the compartment disposed in the base.

10. The refrigerated merchandiser system of claim 1, wherein the refrigerated merchandiser system further includes a sensor disposed in the case, the controller in electrical communication with the sensor.

11. A refrigerated merchandiser system comprising:

a case defining a product display area to support food product, the case having a door adjacent a front of the case and a door heater coupled to the door, and the case defining a compartment;

a low temperature modular refrigeration unit sized to fit within the compartment and operably couple to the case to maintain food product within a low temperature range, the low temperature modular refrigeration unit including an electronic control;

a medium temperature modular refrigeration unit sized to fit within the compartment and operably couple to the case to maintain food product within a medium temperature range, the medium temperature modular refrigeration unit including an electronic control; and a controller in electrical communication with the electronic control on one of the low temperature modular refrigeration unit and the medium temperature refrigeration unit, and in electrical communication with the door heater, the controller programmed to activate the door heater only in response to the low temperature modular refrigeration unit positioned within the compartment.

12. The refrigerated merchandiser system of claim 11, wherein the low temperature modular refrigeration unit and the medium temperature refrigeration unit include supports, and the electronic controls on the low temperature modular refrigeration unit and the medium temperature modular refrigeration unit are mounted on the supports.

13. The refrigerated merchandiser system of claim 11, wherein the case includes a sensor that detects a temperature of the product display area, and wherein the controller is in electrical communication with the sensor.

14. The refrigerated merchandiser system of claim 11, wherein each of the low temperature modular refrigeration unit and medium temperature modular refrigeration unit defines a closed refrigerant circuit and includes an evaporator, a compressor, and a condenser.

15. The refrigerated merchandiser system of claim 11, wherein the low temperature range is at or below 32 degrees Fahrenheit.

16. The refrigerated merchandiser system of claim 11, wherein the medium temperature range is between 33-41 degrees Fahrenheit.

17. A method of controlling condensation in a merchandiser having a case defining a product display area, the method comprising:

determining whether the merchandiser is using one of a low temperature modular refrigeration unit and a medium temperature modular refrigeration unit, the one of a low temperature modular refrigeration unit and medium temperature modular refrigeration unit being removably coupled to the case within a compartment in the merchandiser and replaceable by the other modular refrigeration unit;

determining whether a product display temperature is above a predetermined threshold in response to determining that the merchandiser is using the low temperature modular refrigeration unit;

activating a door heater to remove condensation from a door on the merchandiser in response to determining that the product display temperature is above the predetermined threshold; and turning off the door heater in response to determining that the product display temperature is below the predetermined threshold.

18. The method of claim 17, wherein the step of determining whether the merchandiser is using the low temperature modular refrigeration unit includes communicating with electronic controls on the low temperature modular refrigeration unit.

19. The method of claim 17, wherein the step of determining whether the product display temperature is above the predetermined threshold includes sensing the product display temperature with a sensor disposed in the product display area.

20. The method of claim 17, wherein the door heater is left off when the merchandiser is using the low temperature modular refrigeration unit.

* * * * *